United States Patent [19]

Finke

[11] 3,955,696

[45] May 11, 1976

[54] BOTTLE AND SAFETY CLOSURE

[75] Inventor: Klaus Werner Finke, Finnentrop-Lenhausen, Germany

[73] Assignee: Robert Finke Kunststoff-Spritzguss-Werk, Finnentrop, Germany

[22] Filed: Oct. 15, 1974

[21] Appl. No.: 514,910

[30] Foreign Application Priority Data

Oct. 26, 1973 Germany ..... 2353742

[52] U.S. Cl. ..... 215/214; 215/224; 215/252; 215/258; 215/318; 215/211

[51] Int. Cl.[2] ..... B65D 55/02; B65D 85/56; A61J 1/00

[58] Field of Search ..... 215/9, 211, 214, 218, 215/224, 223, 258, 252, 318

[56] References Cited

UNITED STATES PATENTS

| | | | |
|---|---|---|---|
| 3,695,475 | 10/1972 | Ruekberg | 215/224 |
| 3,737,064 | 6/1973 | Patel et al. | 215/252 |
| 3,792,793 | 2/1974 | Rose | 215/9 |

*Primary Examiner*—George T. Hall
*Attorney, Agent, or Firm*—Toren, McGeady and Stanger

[57] ABSTRACT

A bottle or similar container is provided with a safety closure comprising a push-on cap having a sealing plug on its base penetrating into the bottle mouth and having projections on the inside of its peripheral wall which engage behind an annular beading on the bottle neck to retain the cap on the bottle. In addition to the beading, mutually opposite cams project from the bottle neck each providing an upper surface which ascends in a circumferential direction towards the bottle mouth. The peripheral wall of the cap, which is made of a slightly flexible material, is spaced from the bottle neck and at mutually opposite positions on its inside there are inwardly projecting cam followers which clear the cams when the cap is rotated normally but which engage and ride up the upper cam surfaces when the cap is pressed inwards in the regions of the followers and the cap is simultaneously rotated in the same direction as the cam surfaces ascend, thereby pushing the cap off the bottle.

11 Claims, 9 Drawing Figures

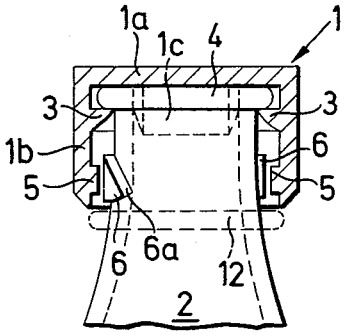
FIG. 1
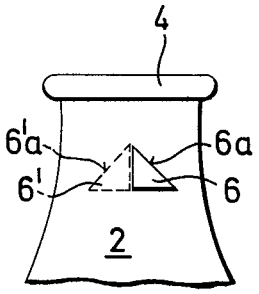
FIG. 2
FIG. 3
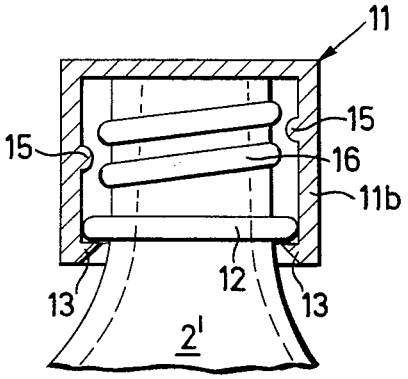
FIG. 4
FIG. 5
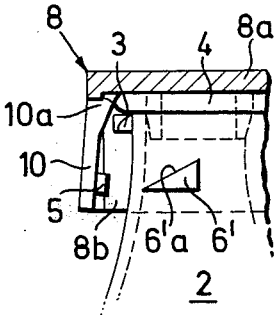
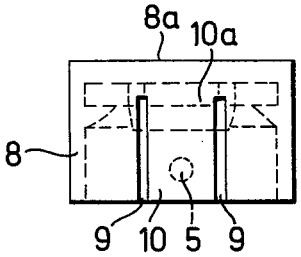

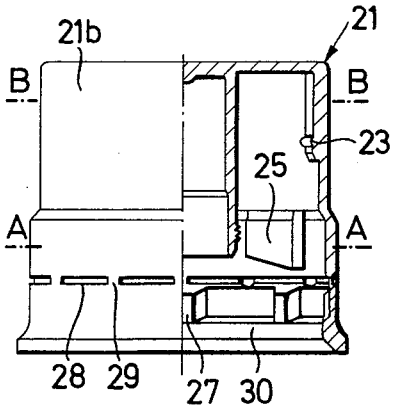
FIG. 6
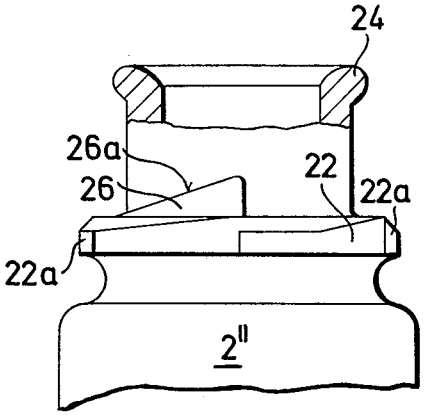
FIG. 8
FIG. 7
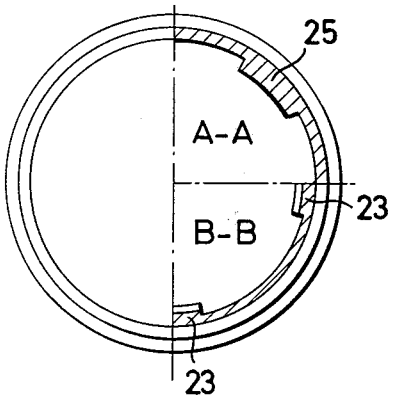
FIG. 9
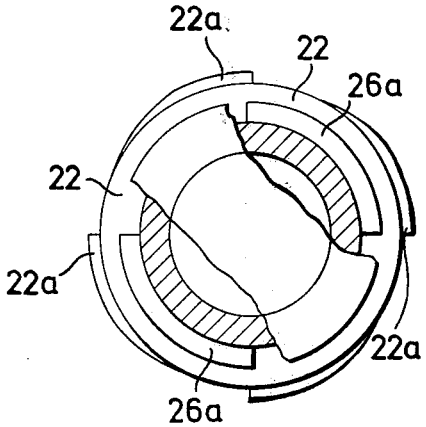

BOTTLE AND SAFETY CLOSURE

This invention relates to bottles and similar containers which are equipped with a so-called "childproof safety closure" of the kind comprising a cap which is made of a material having a low elastic deformability and which is located on the neck of the bottle or similar container with the peripheral wall of the cap spaced from the neck, and means for preventing removal of the cap from the bottle or similar container unless rendered ineffective by pressing the peripheral wall of the cap inwards at substantially diametrically opposite positions. Further reference to bottles in the specification and claims should be taken as a reference to bottles and similar containers.

In a known form of closure of this type, the cap can be screwed in a leak-tight manner in the usual way by an internal thread onto the externally threaded neck of the bottle, and is equipped at the lower end of its unthreaded portion, surrounding the bottle neck at a distance, with two opposite and downwardly oriented protuberances which, together with sawtooth shaped projections on the bottle neck situated in the same region of rotation when the cap is in the closed position, constitute a "sawtooth" lock or ratchet lock preventing unscrewing of the cap. In order to unscrew the cap it is necessary to move the parts of this lock out of engagement by deforming the unthreaded portion of the cap peripheral wall by the exertion of pressure towards the bottle neck upon the portions of the cap perimeter situated between the protruberances, so that the distance from the bottle neck of the parts of the cap peripheral wall equipped with the protruberances in increased to an amount exceeding the height of the projections provided on the neck.

This known form of bottle closure suffers from the disadvantage that the parts of the lock are readily visible and their method of operation easily recognisable. A further disadvantage is that in order to unscrew well sealed and therefore firmly seated screwed caps it is necessary to exert considerable forces by thumb and forefinger at opposite points of the cap peripheral wall inwards towards the bottle neck to achieve sufficient friction between the cap and the hand, and if by chance the positions at which force is exerted are situated between the protruberances on the cap perimeter the forces may easily be sufficiently large to lift the protruberances on the cap edge away from the bottle neck and clear of the locking teeth, so that the cap can be unscrewed without the safety lock being intentionally released.

Another known form of cap closure of the kind described also comprises an internally threaded cap which can be tightly screwed onto an externally threaded bottle neck. This closure additionally comprises a second cap, entirely covering the first cap, and the two caps are connected to each other nondetachably in the axial direction. The second cap is rotatable on the first cap, and the caps are coupled together in the circumferential direction by a sawtooth lock which acts in the screwing up or closure direction. To open the closure by rotating the external cap in the opposite direction, it is necessary, by exerting forces towards the bottle neck at any two approximately opposite points on the flexible peripheral wall of the outer cap, to produce between the caps the frictional force necessary to rotate the inner cap. With this arrangement, the threaded inner cap and locking components cannot be seen nor affected from outside, but the risk is even greater than with the earlier described arrangement that the closure can be opened accidentally since the forces used for producing adequate friction between hand and the outer cap to release a firmly seated screwed cap may be sufficient to hold the outer cap in engagement with the inner cap and thereby unscrew the inner cap.

As with known screw cap safety closures, the object of the present invention is to provide a safety closure of the kind described which is economic to construct and in which the force required to release it cannot be applied by fairly small children and, in addition, the measures required are not obvious even to adults.

According to the invention a bottle and safety closure of the kind described is characterised in that the cap is a push-on cap having a sealing plug on its base penetrating into the bottle mouth and also having retaining means on the peripheral wall of the cap which co-operate with means on the bottle neck to hold the cap on the bottle so that they can only be separated by a relatively large axial force, and in that mutually opposite cams project from the bottle neck providing at least one upper surface which ascends in a circumferential direction towards the bottle mouth, and at mutually opposite positions on the inside of the peripheral wall of the cap there are inwardly projecting cam followers which clear the cams when the cap is rotated normally but which engage and ride up on the upper surfaces of the cams when the cap is pressed inwards in the regions of the cam followers and the cap is simultaneously rotated in the same direction as the upper surfaces of the cams ascend.

In a closure constructed in accordance with the invention, the cap cannot be recognised from the outside as a push-on cap and the most obvious way to open it is first of all to turn the cap to the left, as in the most commonly known screw-cap closures. It is then found that this rotation, only slightly resisted by the fit between the plug and the bottle mouth and the frictional connection between the retaining means of the cap and bottle, has no more effect than a rotation in the other direction. It is also of no avail to attempt to pull the cap axially off the bottle neck, because under the effect of the forces which must be exerted for this purpose by friction of the hand on the cap, the retaining means acting between the cap and the bottle neck are brought yet further into engagement, the greater these forces become. It is only possible to open the closure if the cam followers are pressed onto the bottle neck by the exertion of forces upon the peripheral wall of the cap in the narrow region of the followers, while simultaneously the cap is rotated in a direction in which the cam followers can run onto the upper surfaces of the cams on the bottle neck and can thereby push the cap off the bottle neck.

The features of the invention make possible a very considerable change in the psychological and technical difficulties which prevent the closure from being opened. For example, opening may be made more difficult by arranging for the riding surfaces of the cams to climb clockwise towards the mouth of the bottle so that consequently it is necessary to rotate the cap in a clockwise direction in order to open it, which is opposite to usual practice. The position of the cam followers can be marked more or less clearly upon the outer side of the cap.

By arranging that each cam has a pair of upper surfaces which ascend towards each other and the bottle mouth in opposite circumferential directions, the cap can be removed by pressing the peripheral wall inwards in the correct places and rotating the cap either clockwise or anticlockwise. Either way the followers will ride up on the cams and will push the cap off the bottle.

The forces for opening the closure are largely affected, not only by the construction of the locking means, by the varying elastic deformability of the cap wall as a function of the material selected and the peripheral wall thickness, but also by the greater or lesser slope of the riding surfaces of the cams. By selecting a relatively hard material for the cap, it is possible to make the separation of the retaining means more difficult, whereas by locally weakening the cap peripheral wall to a greater or lesser extent around the cam followers, it is possible to make easier the pressing of the cap onto the bottle neck.

The provision of an annular beading upon the bottle neck approximately directly below the edge of the cap would make it possible to lift off the cap, an operation known to be difficult, using minimum force by means of a simple tool such as a screw driver, knife blade or the like.

Various embodiments of the present invention are shown diagrammatically in the accompanying drawings, in which:

FIG. 1 is an elevation of a portion of one example of a bottle and safety closure constructed in accordance with the invention, the cap being shown in axial section;

FIG. 2 is an elevation of the bottle neck shown in FIG. 1, after rotation through 90° about its axis;

FIG. 3 is a view similar to that of FIG. 1 but illustrating a different example in accordance with the invention;

FIG. 4 is a part of a view similar to that of FIGS. 1 and 3, but illustrating a third example in accordance with the invention;

FIG. 5 is an elevation of the cap shown in FIG. 4, the cap being rotated through 90°;

FIG. 6 is a part elevation, part sectional, view of the cap of a fourth example in accordance with the invention;

FIG. 7 is a top plan view of the cap shown in FIG. 6, the top right quarter being a section through the periphery on the line A—A, and the bottom right quarter being a section through the periphery on the line B—B;

FIG. 8 is an elevation of the bottle neck on which the cap of FIGS. 6 and 7 is designed to fit; and, FIG. 9 is a top plan, with parts cut away, of the bottle neck shown in FIG. 8.

In the embodiment shown in FIGS. 1 and 2, a push-on cap 1 is held upon the bottle neck 2 in its closed position by retaining means, which consist of an external annular beading 4 on the neck 2 surrounding the bottle mouth and of strip-like projections 3 on the inner face of the cap peripheral wall **1*b* which engage behind, i.e. below, the beading 4. A hollow plug 1*c* projecting from the base of the cap into the mouth of the bottle seals the bottle. The portion of the cap peripheral wall 1*b* situated below the projections 3 surround the bottle neck 2 with some radial clearance. From the inner face of the cap wall 1*b* near its lower edge two diametrally opposed cam followers 5 project into the annular space between the wall 1*b* and the bottle neck 2, terminating at a distance from the bottle neck 2. At the level of these cam followers 5, oppositely situated cams 6 are provided upon the bottle neck 2, each having an upper surface 6*a* climbing in a clock-wise direction towards the mouth of the bottle. These upper cam surfaces 6*a* constitute riding surfaces for the cam followers 5 only when the cam followers are pressed onto the bottle neck by forces exerted in their vicinity upon the peripheral wall 1*b* and the cap 1** is simultaneously rotated clock-wise.

In FIG. 2, broken lines indicate a cam 6' formed as a mirror arrangement of the cam 6. These cams 6 and 6' can be provided instead of the single cam 6, and may be formed integrally as a roof-shaped cam having two upper riding surfaces **6*a* and 6*a'*** which ascend in opposite directions.

FIG. 1 shows in broken lines a second annular beading 12 on the bottle neck 2 immediately below the cap 1. The beading 12, if provided, prevents the cap 1 from being pushed off by finger pressure exerted upon the rim of the cap, but facilitates removal of the cap by the application of a tool lever edge. If desired, this can also be rendered impossible by arranging for the lower edge of the cap to extend further down, at least to cover the upper edge of the annular beading 12.

The cams having upper surfaces which climb in one direction towards the bottle mouth may form parts of a screw thread, with the turns of which the cam followers, offset by one half the pitch of the thread, can be brought into engagement. The cam followers on the peripheral wall of the cap may also form parts of an internal screw thread, which is arranged to engage the cams, in the form of projections or an external screw thread, upon the bottle neck when the cap is pressed inwards. In this case, parts of the internal thread can be brought into engagement with the projections or the external thread on the bottle neck, by squeezing the cap at any mutually opposite points on the cap wall.

As can be seen from FIG. 3, it is possible to use, for a push-on cap closure in accordance with this invention, a conventional bottle having its neck 2' equipped with an external screw thread 16 and an annular beading 12 below the thread. The annular beading 12, known as a so-called holding or transfer ring, is used during the manufacture of the bottle for transferring the still unfinished bottle between various work stations and conveying devices. This annular beading 12 functions, in the concept of the invention as the retaining means on the bottle neck which is engaged by detent projections 13 provided at the lower edge of the cap peripheral wall **11*b* as shown to retain the cap on the bottle. For removing the cap 11 from the bottle, mutually opposite projections 15 forming cam followers on the cap peripheral wall 11*b*, offset axially by one half pitch of the thread 16**, are provided.

In this case, the torsional force required for lifting the cap from the bottle may be reduced by arranging that the detent projections which are distributed about the periphery of the free edge of the cap engage the annular beading 12 on the bottle neck with radial clearance between the projections and the neck. When the portion of the cap peripheral wall situated in the vicinity of the screw thread 16 is squeezed, the free edge of the cap adopts together with the squeezed wall portion an oval form, so that the detent projections 13 situated in the regions of maximum diameter of the cap edge are displaced outwards from the bottle neck and, when the cap 11 is rotated, can be lifted with correspondingly greater ease over the annular beading 12 on the bottle neck.

In the embodiment of FIGS. 4 and 5, the push-on cap 8 has a pair of incisions 9 extending on each side of each cam follower 5 from the edge of the cap almost to the cap base 8*a*, forming a tongue 10 in the cap peripheral wall 8*b*. The tongues 10 make it possible to press the cam followers 5 situated thereon against the bottle neck using lesser force. Instead of the separating incisions shown, it is possible to provide grooves of a suitable depth, preferably on the inner face of the cap wall. These accordingly reduce the resistance of the cap wall in the vicinity of the cam followers by a rather smaller amount than incisions.

The tongues 10 are situated in the spaces between two detent strip projections 3, and are each furnished at the transition into the cap base 8*a* with an internal wedge-shaped thickened portion 10*a* tapering towards the edge of the cap. These portions 10*a* cause the lower parts of the tongues, when the cap is pushed on, to be pressed outwards away from the bottle neck 2 by the annular retaining beading 4 around the bottle mouth. This also enables the diameter of the cap to be kept smaller and the annular space between it and the bottle neck narrower, without the rotation of the cap causing the cam followers to engage the cams 6, 6' on the bottle neck when no radial force is exerted upon the tongues 10. The outward projection of the tongues beyond the periphery of the cap also makes it possible to feel the position of the cam followers 5 and thereby makes it easier to find the locations at which pressure must be exerted in order to open the bottle closure.

In the embodiment illustrated in FIGS. 6 to 9, a push-on closure cap 21 engages a first annular beading 24 surrounding the bottle mouth by means of inward detent projections 23 to hold the cap on the bottle, and has cam followers 25 which bear on an annular surface on a second annular beading 22 around the bottle neck. Riding surfaces 26*a* of cams 26 on the bottle neck 2'' ascend towards the bottle mouth from the upper side of the second annular beading 22 inwardly of the followers 25. The cams 26 may constitute the lower ends of the turns of a multiturn external screw thread, and the cam followers 25 may constitute the lower ends of the turns of a multi-turn internal screw thread of the same pitch.

In the example shown, the cap 21 is, in contrast to the embodiments so far described, additionally secured against rotation and thereby additionally against undesired separation from the bottle neck. Projections 22*a*, oriented radially outwards from the circumference of the annular beading 22 and of sawtooth shape serve for this purpose, engaging with their steep flanks abutment surfaces of locking projections 27 on the lower edge portion of the cap peripheral wall 21*b*, which surrounds the annular beading 22 and engages behind it by means of an internal thickened portion 30. This edge portion is connected to the upper part of the cap peripheral wall 21*b* by thin webs 29 separated by incisions 28.

For the first removal of the cap 21 from the bottle, it is necessary to exert considerably force, on the one hand by rotating the cap counter clock-wise to tear through the webs 29, and on the other hand in order to press the cam followers 25 simultaneously onto the bottle neck. Only when these cam followers have been pressed in this way, will the webs 29 be subjected to axial tension as the cap is rotated, thus substantially facilitating the tearing of these webs.

I claim:

1. In a bottle and safety closure of the kind comprising a bottle having a neck surrounding a mouth, a cap which is made of a material having a low elastic deformability and which has a base and a peripheral wall depending downwardly from said base, said cap located on said neck with said peripheral wall spaced outwardly from said neck, and means for preventing removal of said cap from said bottle unless rendered ineffective by pressing said peripheral wall of said cap inwards at substantially diametrically opposite positions, the improvement wherein said cap is a push-on cap, said cap base has a sealing plug penetrating into said bottle mouth, and said means for preventing removal of said cap from said bottle comprises cooperating retaining means on said bottle neck and said peripheral wall of said cap, said co-operating retaining means including cams located on opposite sides of and projecting outwardly from said bottle neck, said cams spaced angularly apart, at least one upper surface on each of said cams ascending in the circumferential direction of said neck towards said bottle mouth, and cam followers formed on and projecting inwards from opposite positions on the inside of said peripheral wall of said cap, said cam followers spaced angularly apart and located in the range of said cams when said sealing plug penetrates into said bottle mouth, said cam followers located radially outwardly from and clear of said cams when said cap is rotated normally about said bottle neck but when said peripheral wall of said cap is pressed inwards in the regions of said cam followers and said cap is simultaneously rotated in the same direction as said upper surfaces of said cams ascend, said cam followers engage and ride up on said upper surfaces of said cams for releasing said means for preventing removal, and the total circumferential dimension of said cams and of said cam followers being significantly less than the total circumferential dimension of said neck.

2. A bottle and safety closure as claimed in claim 1, wherein said upper surfaces of said cams ascend towards said bottle mouth in a clock-wise direction.

3. A bottle and safety closure as claimed in claim 1, wherein each of said cams has a pair of said upper surfaces which ascend in a circumferential direction towards said bottle mouth, said pair of upper surfaces ascending towards each other in opposite circumferential directions.

4. A bottle and safety closure as claimed in claim 1, wherein said co-operating retaining means comprises an annular beading disposed on said bottle neck below said cams, and at least one detent projection disposed at the free edge of said peripheral wall of said cap, said at least one detent projection engaging the under side of said annular beading.

5. A bottle and safety closure as claimed in claim 4, wherein said at least one detent projection engages the underside of said annular beading with a radial clearance between said at least one detent projection and said bottle neck below said annular beading.

6. A bottle and safety closure as claimed in claim 1, wherein said peripheral wall of said cap is provided with separating incisions on each side of each of said cam followers, said incisions extending from the free edge of said peripheral wall almost to said cap base whereby said peripheral wall includes tongue portions between said incisions and said cam followers are located on said tongue portions.

7. A bottle and safety closure as claimed in claim 6, wherein said co-operating retaining means comprises an annular beading on said bottle neck adjacent said bottle mouth and detent projections on the inside of said peripheral wall of said cap between said tongue portions, said detent projections engaging the under side of said annular beading, and said cap includes wedge-shaped thickened portions at the junctions of said tongue portions with said cap base whereby said tongue portions together with said cam followers are spring outwards by said annular beading away from said bottle neck when said cap is pushed on said bottle.

8. A bottle and safety closure as claimed in claim 1, wherein said peripheral wall of said cap is provided with grooves on each side of each of said cam followers, said grooves extending from the free edge of said cap almost to said cap base whereby said peripheral wall is rendered more flexible in the regions of said cam followers.

9. A bottle and safety closure as claimed in claim 1, wherein said bottle neck is provided with an annular beading below said cams, said upper surfaces of said cams ascend from the upper side of said annular beading, and said cam followers of said cap bear on said upper surface of said annular beading when said cap is located on said bottle.

10. A bottle and safety closure as claimed in claim 9, wherein said cams constitute the lower ends of the turns of a multi-turn external screw thread, and said cam followers constitute the lower ends of the turns of a multi-turn internal screw thread of the same pitch as said external screw thread.

11. A bottle and safety closure as claimed in claim 8, wherein said annular beading has an outer periphery equipped with a plurality of sawtooth shaped radial projections, steep flanks on said sawtooth projections providing abutment surfaces, and said cap including upper and lower portions and webs connecting said upper and lower portions at circumferential intervals above said annular beading whereby said lower portion of said cap surrounds said annular beading, said lower portion of said cap having an inwardly directed thickened portion engaging below said annular beading, and internal projections above said thickened portion for engagement with said abutment surfaces of said sawtooth projections on said periphery of said annular beading.

* * * * *